US008321996B2

(12) United States Patent
Hirtsiefer

(10) Patent No.: US 8,321,996 B2
(45) Date of Patent: Dec. 4, 2012

(54) HOLDING ELEMENT FOR ADJUSTING A LID OF A PIECE OF FURNITURE

(75) Inventor: Artur Hirtsiefer, Neunkirchen-Seelschied (DE)

(73) Assignee: HUWIL Bútoripari és Üzletberendezési Rendszerek kft, Budapest (HU)

( * ) Notice: Subject to any disclaimer, the term of this patent is extended or adjusted under 35 U.S.C. 154(b) by 0 days.

(21) Appl. No.: 12/863,671

(22) PCT Filed: Jan. 12, 2009 (Under 37 CFR 1.47)

(86) PCT No.: PCT/EP2009/000104

§ 371 (c)(1), (2), (4) Date: Dec. 10, 2011

(87) PCT Pub. No.: WO2009/092519

PCT Pub. Date: Jul. 30, 2009

(65) Prior Publication Data

US 2012/0084944 A1 Apr. 12, 2012

(30) Foreign Application Priority Data

Jan. 21, 2008 (DE) ..... 10 2008 005 463

(51) Int. Cl.
*E05F 1/08* (2006.01)

(52) U.S. Cl. ..... 16/286; 16/289; 16/354

(58) Field of Classification Search ..... 16/286–289, 16/370, 371, 331, 322, 325, 327, 354, 366; 49/386, 387, 254, 255, 246; 312/322–325, 312/319.1, 319.4; 74/89.18

See application file for complete search history.

(56) References Cited

U.S. PATENT DOCUMENTS

| | | | | |
|---|---|---|---|---|
| 5,271,652 | A * | 12/1993 | Watanabe et al. | 296/36 |
| 6,374,459 | B1 * | 4/2002 | Zetti | 16/366 |
| 7,096,535 | B2 * | 8/2006 | Lin | 16/287 |
| 7,178,202 | B2 * | 2/2007 | Hirtsiefer et al. | 16/366 |

(Continued)

FOREIGN PATENT DOCUMENTS

DE 296 05 551 U1 5/1996

(Continued)

*Primary Examiner* — Chuck Y. Mah

(74) *Attorney, Agent, or Firm* — Harness, Dickey & Pierce, P.L.C.

(57) ABSTRACT

A holding element for adjusting a lid (4) of a piece of furniture between a closed position and an open position has a first fitting part (1) that is connectable to the body (2) of a piece of furniture. A second fitting part (3) is connectable to the lid (4). A first support arm (5) is pivotably fastened around a first body axis (7) to the first fitting part (1) and is pivotably fastened around a first lid axis (8) to the second fitting part (3). A second support arm (6) is pivotably fastened around a second body axis (9) to the first fitting part (1) and is pivotably fastened around a second lid axis (10) to the second fitting part (3). A lever (19) is pivotably fastened around a pivot axis (20) to the first fitting part (1). An adjustment arm (26) is pivotably connected to the lever (19) at a distance from the pivot axis (20). The adjustment arm (26) is pivotably fastened around a third lid axis (28) to the second fitting part (3). A drive force (12) urges the lever (19), with a force, to a first pivot direction. In the open position of the lid (4), the first support arm (5) and the second support arm (6) intersect each other.

13 Claims, 4 Drawing Sheets

U.S. PATENT DOCUMENTS

| | | | | |
|---|---|---|---|---|
| 7,543,356 | B2 * | 6/2009 | Zetti | 16/288 |
| 7,797,796 | B2 * | 9/2010 | Migli | 16/366 |
| 7,810,213 | B2 * | 10/2010 | Brustle | 16/286 |
| 7,886,407 | B2 * | 2/2011 | Resnik et al. | 16/286 |
| 2001/0039762 | A1 * | 11/2001 | Giovannetti | 49/246 |
| 2002/0108311 | A1 * | 8/2002 | Salice | 49/371 |
| 2004/0239213 | A1 * | 12/2004 | Hirtsiefer | 312/109 |
| 2008/0121490 | A1 * | 5/2008 | Dubach et al. | 192/17 D |
| 2008/0276422 | A1 * | 11/2008 | Beckmann et al. | 16/258 |
| 2009/0072551 | A1 | 3/2009 | Hirtsiefer | |

FOREIGN PATENT DOCUMENTS

| | | | |
|---|---|---|---|
| DE | 102004019785 | A1 | 11/2005 |
| EP | 1785567 | A | 5/2007 |
| WO | WO-2006/111236 | A | 10/2006 |

* cited by examiner

HOLDING ELEMENT FOR ADJUSTING A LID OF A PIECE OF FURNITURE

CROSS-REFERENCE TO RELATED APPLICATIONS

This application is a 371 U.S. National Stage of International Application No. PCT/EP2009/000104, filed Jan. 12, 2009. This application claims the benefit of German Patent Application No. 10 2008 005 463.1, filed Jan. 21, 2008. The Disclosures of the above applications are incorporated herein by reference.

FIELD

The disclosure relates to a holding element, especially a lid stay, for adjusting a lid of a piece of furniture between a closed position and an open position. The holding element serves to adjust a lid that is not connected, via hinges, directly to a body of a piece of furniture.

BACKGROUND

Such a holding element is shown in DE 296 05 551 U1. The holding element includes two levers, which, respectively, are pivotably mounted on the body-sided fitting part and on a lid-sided fitting part. The body-sided fitting part is fastened to a body of a piece of furniture. The lid-sided fitting part is fastened onto the lid. The levers are arranged trapezoidal and form a linkage with four elements. Thus, the movement kinematics of the lid relative to the body is given by the arrangement of the levers. The lid can be opened to the top. Here, a tension spring is provided that engages on a body-sided fitting part and on a lid-sided fitting part. The tension spring acts with a force on the lid-sided fitting part to hold the lid in the open position or self-actingly moves the lid into the open position. Furthermore, the tension spring is arranged such, that, when passing through the dead center point, the lid is also held in the closed position.

SUMMARY

An object of the present disclosure is to provide a holding element that holds the lid in any position across the largest possible pivot range between the closed position and the open position.

The object is solved according to the disclosure by providing a holding element to adjust a lid of a piece of furniture between a closed position and an open position. The holding element comprises a first fitting part, that is connectable to a body of a piece of furniture, and a second fitting part, that is connectable to the lid. A first support arm is pivotably fastened around a first body axis to the first fitting part and pivotably fastened around a first lid axis to the second fitting part. A second support arm is pivotably fastened around a second body axis on the first fitting part and pivotably fastened around a second lid axis on the second fitting part. A lever is pivotably fastened around a pivot axis to the first fitting part. An adjustment arm is pivotably connected to the lever at a distance from the pivot axis. Also, the adjustment arm is pivotably fastened around a third lid axis on the second fitting part. A drive force urges the lever, with a force, in a first pivot direction that corresponds to the pivot movement of the lid to the open position. In the open position of the lid, the first support arm and the second support arm intersect each other.

The support arms are trapezoidally arranged and form a linkage with four elements. Thus, the kinematic movement of the lid is given relative to the body by the arrangement of the support arms.

It has been proven that by the arrangement of the lever, which is acted upon by a drive force, the adjustment arm exerts a torque onto the lid, such that across a large pivot range of the lid, the lid is held in any arbitrary position.

The arrangement of the support arms, such that they intersect each other in the open position of the lid, provides good support of the lid and enables the lid to be held across the largest possible angle range in any arbitrary position. Accordingly, the support arms are not arranged parallel to each other. This means, that a first plane, that contains the first body axis and the first lid axis, and a second plane, that contains the second body axis and the second lid axis, intersect in one axis of rotation. The lid rotates around this axis of rotation. The axis of rotation moves three-dimensionally. In the open position, the axis of rotation is arranged between the first body axis and the first lid axis or between the second body axis and the second lid axis, so that the support arms intersect.

In this case, the body axes, the lid axes and the pivot axis are arranged parallel to each other.

The drive force can be materialised by a spring accumulator that is supported on the first fitting part and on the lever. The spring accumulator may have a compression spring element. The spring accumulator has a base element that is pivotably arranged on the body-sided first fitting part. An adjustment slider is axially guided on the base element. At least one compression spring element is supported on the base element and on the adjustment slider. The at least one compression spring urges the adjustment slider in a direction towards an extended position. The adjustment slider is further articulatedly fastened to the lever.

To be able to use the same holding element for different lids, especially of different weights, an adjustment mechanism is provided to adjust the force application point where the spring accumulator acts on the lever.

The adjustment mechanism may comprise an adjustment lever that is pivotably fastened to the lever. The adjustment lever is retainable in different pivot positions relative to the lever. The spring accumulator is pivotably fastened to and supported on the adjustment lever. Thus, the lever is indirectly acted upon by a force via the adjustment lever. Generally, it is also conceivable, that the force application point is linearly displaceable. For this, it is possible to use a spindle drive, for example.

The lever has a first lever portion, starting from the pivot axis, and a second lever portion. The second lever portion is arranged to extend from the pivot axis opposite to the first lever portion. The adjustment arm is pivotably fastened onto the first lever portion and the drive force acts on the second lever portion. Thus, the lever is formed as a rocker that diverts the force from the drive force onto the adjustment arm. The lever is pivotably supported on a trunnion, via a central bore, to provide pivotable attachment of the lever. The trunnion is connected to the body-sided first fitting part.

In this case, the lever is provided with a slot that ends, starting from an outer contour of the lever, in the central bore. The slot is arranged such that, when a force from the adjustment arm and the spring accumulator is applied onto the lever, the lever with a wall, that delimits the central bore, is clamped tighter onto the trunnion. Thus, depending on the strength of the applied forces, the wall is pressed tighter onto the trunnion so that a higher frictional force is produced. When opening the lid, the force transmitted onto the lever gets larger. Thus, a larger frictional force is produced. Additionally, a small force imbalance is produced between the drive force and the frictional force, that acts on the lever due to the weight of the lid. Thus, this ensures that the lid is held in any arbitrary position. Accordingly, a holding of the lid in any position is made possible across a larger pivot path of the lid.

The holding element may have a damper that dampens the pivot movement of the lid until it reaches the closed position. In this case, the damper is, preferably, arranged such that the pivot movement of the lid, when closing it, is dampened shortly before reaching the closed position. Thus, an undamped pivoting of the lid is possible across the largest pivot angle range.

The damper can have a housing connected to the first support arm. A slider is axially displaceable relative to the housing. The slider is acted upon by a force towards an extended position. An abutment element is fastened to the first fitting part. Thus, when moving the lid into the closed position, the slider approaches the abutment element, until it abuts the abutment element and is moved into a retracted position.

The damper is fastened on the first support arm. The first support arm is pivoted around the first body axis. The abutment element has an abutment face that curvilinearly extends around the first body axis. The path of the abutment face is adaptable to the to be achieved movement path of the lid. The dampening characteristics, across which pivot angle range the lid is dampened and to which amount the lid is dampened, can be varied by changing the path of the abutment face.

The damper can also be formed with the slider held in the housing in a resting position between a completely retracted position and a completely extended position. The slider is released by retracting it into the completely retracted position. A spring is arranged in the housing to displace the slider into the completely extended position. The slider is locked when the slider is again displaced into the completely retracted position. Thus the slider, after reaching the completely retracted position, can only again be extended up to the resting position.

Thus, a push-push function is achieved where an automatic opening of the lid is affected when the lid, in its closed position, is pushed towards the body, whereupon the slider is released. After releasing the lid, the lid is displaced by the slider up to or beyond the dead centre point position. In this case, the spring accumulator can be set such that the lid, after exceeding the dead center position, is displaced automatically by the spring accumulator up to the open position.

Further areas of applicability will become apparent from the description provided herein. The description and specific examples in this summary are intended for purposes of illustration only and are not intended to limit the scope of the present disclosure.

DRAWINGS

The disclosure is described in detail in the following using the drawings. It shows FIG. 1 is a side elevation view of a holding element in an open position within a piece of furniture.

DETAILED DESCRIPTION

FIGS. 1 to 4 show a holding element according to the disclosure in different views and different positions that are described in the following together.

Figure 1:
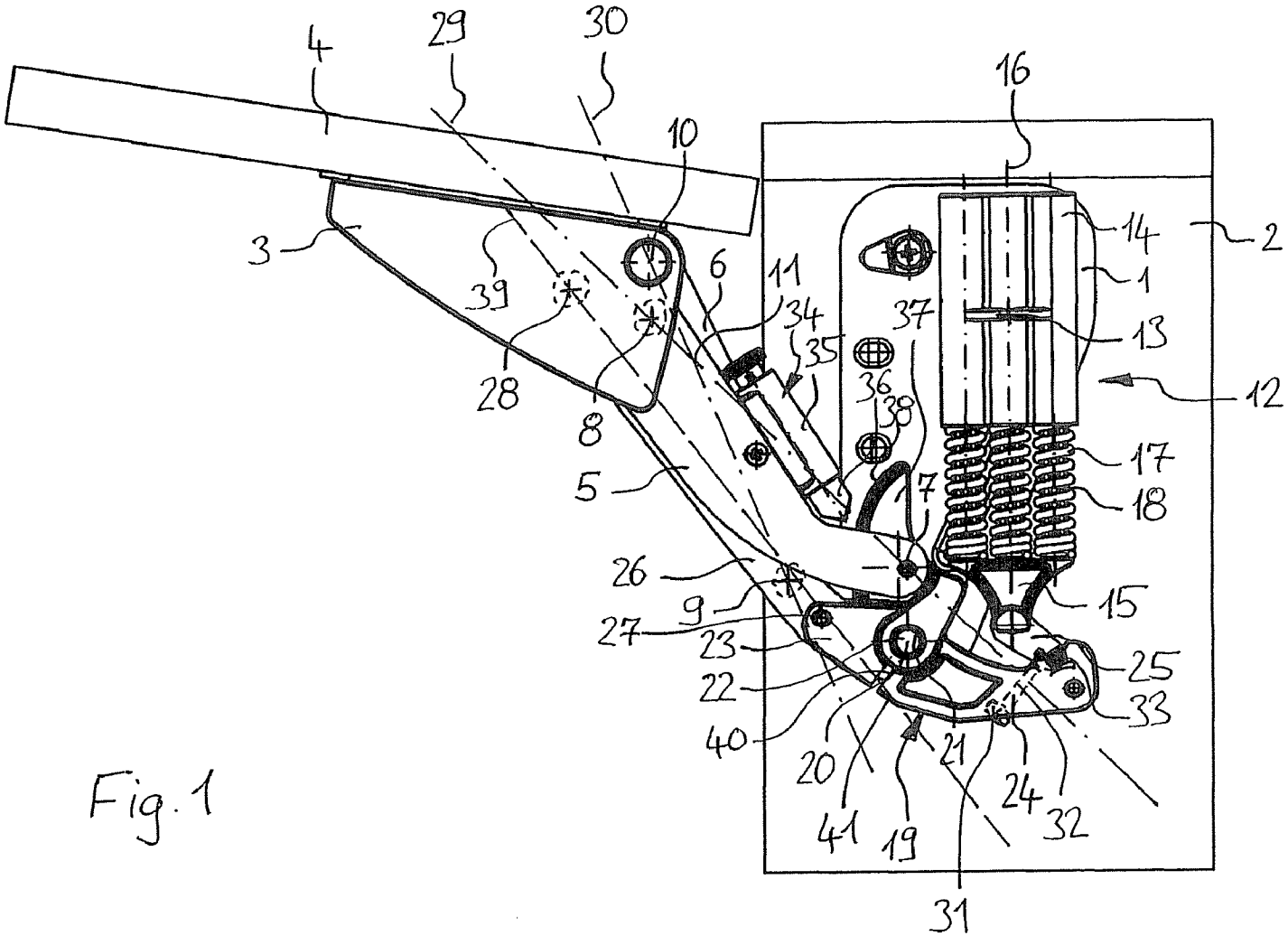
Figure 2:
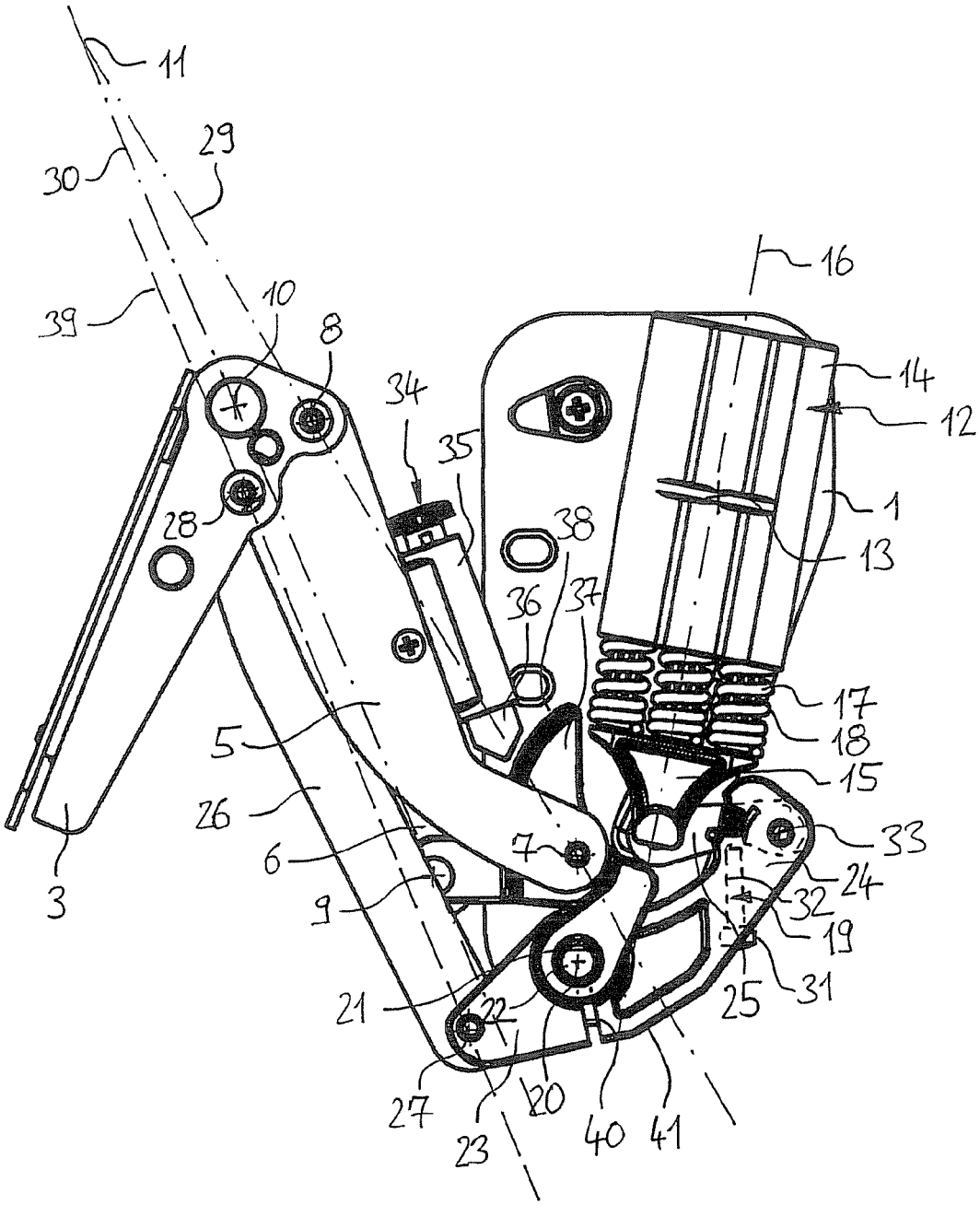
FIG. 2 is a side elevation view of the holding element according to FIG. 1 in an intermediate position.

The holding element has a first fitting part 1, as shown in FIG. 1, that can be fastened to an inside of a body 2 of a piece of furniture. The holding element includes a second fitting part 3, as shown in FIG. 1, that can be mounted on a lid 4 of a piece of furniture. The lid 4 is only connected via the holding element to the body 2 and has no hinges. As will be described later, the lid pivots around an axis that moves three-dimensionally and depends on the structure of the holding element.

The holding element includes a first support arm 5 and a second support arm 6. The first support arm 5 is pivotably fastened on the body-sided first fitting part 2, via a first body axis 7, and on the lid-sided second fitting part 3 around a first lid axis 8. The second support arm 6 is pivotably fastened on the body-sided first fitting part 2, via a second body axis 9, and on the lid-sided second fitting part 4 around a second lid axis 10.

The support arms 5, 6 are not arranged parallel to each other. This means, that a first plane 29 that contains the first body axis 7 and the first lid axis 8, and a second plane 30 that contains the second body axis 7 and the second lid axis 8, intersect each other in an axis of rotation 11. Around this axis of rotation 11, the lid 4 rotates, wherein the axis of rotation 11 moves three-dimensionally, as is visible in FIGS. 1 to 3.

So that the lid 4 is held via the largest possible pivot range in an arbitrary position, a drive is provided. The drive includes a drive force in the form of a spring accumulator 12. The spring accumulator 12 has a base element 14 that is pivotably fastened around a bearing axis 13 onto the body-sided first fitting part 2. An adjustment slider 15 is displaceably held on the base element 14 axially along an adjustment axis 16. The adjustment slider 15 is urged by compression springs 17 that are supported on the base element 14 and on the adjustment slider 15. The adjustment slider 15 is urged in a direction towards a fully extended position by the force. A pin 18 is provided on the adjustment slider 15 for each compression spring 17 so that the compression springs 17 do not kink transversally to the adjustment axis 16. The pins 18 enter into the windings of the compression springs 17 formed as helical springs. The pins 18 support the respective compression spring 17 against lateral bulging.

The drive includes a lever 19, supported on a trunnion 22, that is pivotable around a pivot axis 20. The trunnion 22 is connected to the body-sided first fitting part. The lever 19 has a central bore 21 that enables the lever 19 to be pushed onto the trunnion pin 22. The lever 19 is formed rocker-like and has a first lever portion 23 and a second lever portion 24. The first lever portion 23 starts from the pivot axis 20 and extends approximately radially. The second lever portion 24 starts from the pivot axis 20 and extends opposite to the first lever portion 23 approximately radially.

An adjustment arm 26 is pivotably connected around a third body axis 27 on the first lever portion 23 of the lever 19. The third body axis 27 is arranged at a distance from the pivot axis 20. The adjustment arm 26 is pivotably fastened around a third lid axis 28 to the lid-sided second fitting part 4.

The adjustment slider 15 of the spring accumulator 12 acts indirectly, via an adjustment lever 25, on the second lever portion 24 of the lever 19. The adjustment lever 25 is retainable in different rotational positions relative to the lever 19 on the lever 19. The adjustment slider 15 is freely pivotably fastened on the adjustment lever 25. The force line of action of the spring accumulator 12, that corresponds to the adjustment axis 16, is aligned, such that a torque is produced on the lever in a clockwise direction according to the representation of the FIG. 1. The adjustment arm 26 is arranged such that it produces a torque on the lever 19 in a counter-clockwise direction according to the representation of FIG. 1. In this case, it is ensured across the largest possible pivot range of the lid 4, that the torques, that are produced by the spring accumulator 12 and the lid 4 on the lever 19, cancel each other out, and are in equilibrium, so that the lid 4 is held in the respective pivot position. The pivot range, in which the lid 4 is held in every pivot position, extends, preferably, from the open position according to FIG. 1 to a dead center position, where the force line of action 39 of the adjustment arm 26, along which a force is applied by the adjustment arm 26 to the second fitting part 4, intersects the axis of rotation (this corresponds approximately to the pivot position according to FIG. 2.

Figure 3:
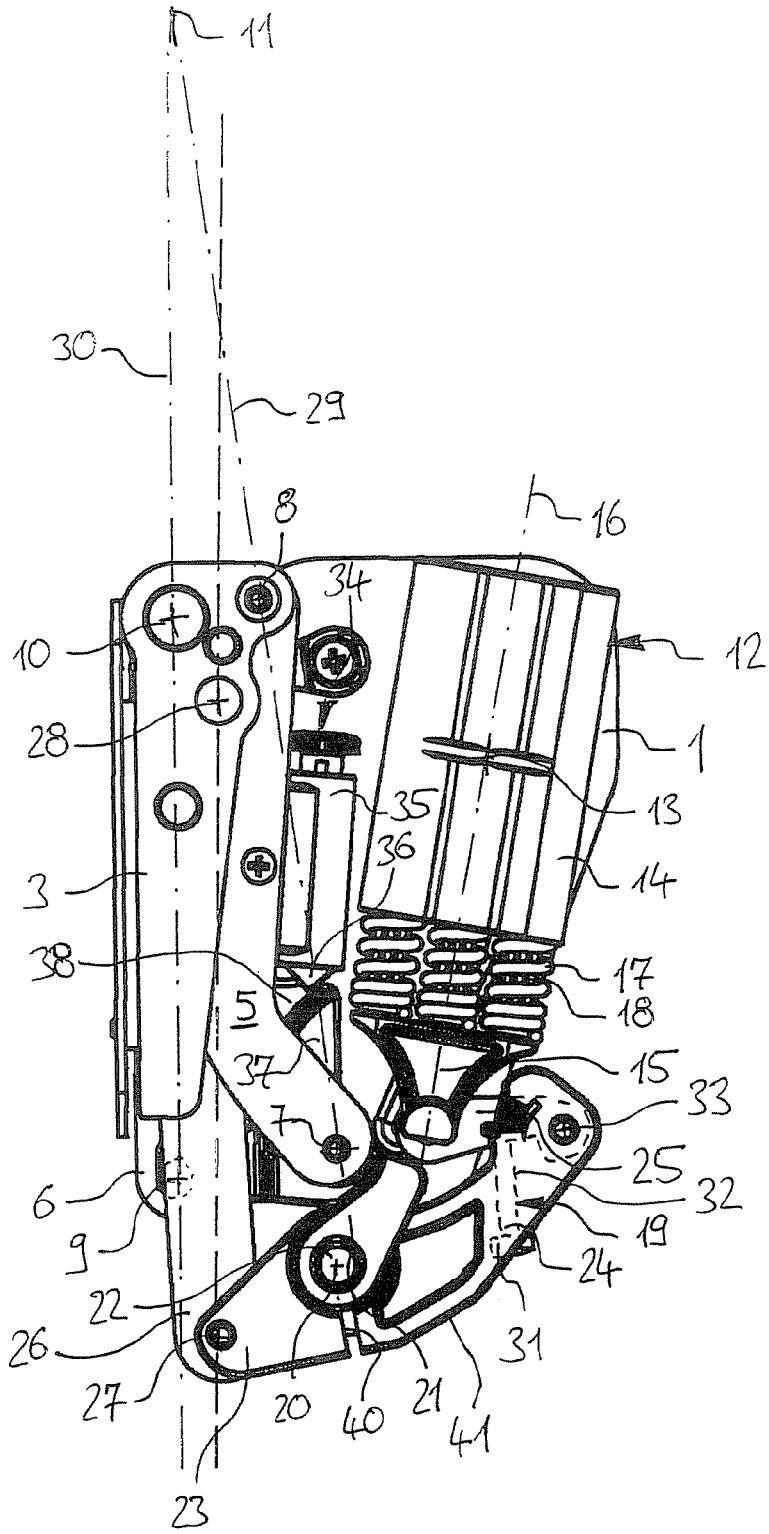
FIG. 3 is a side elevation view of the holding element according to FIG. 1 in the closed position.
Figure 4:
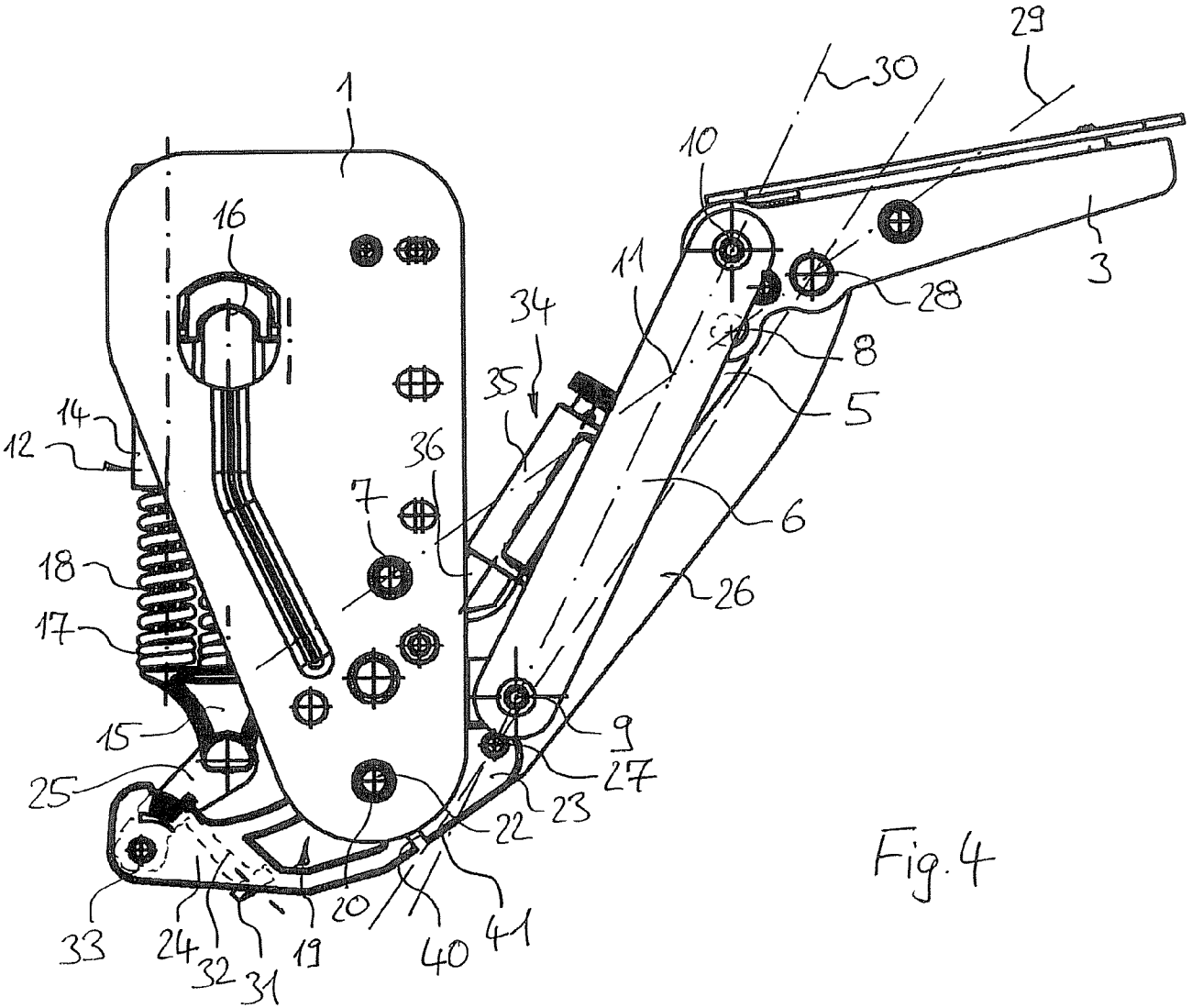
FIG. 4 is a side elevation view of the side of the holding element opposite to that in FIG. 1 in the open position.

Across the pivot angle range, starting from the open position to the dead centre position, the force line of action 39 of the adjustment arm 26 intersects the axis of rotation 11, around which the lid 4 rotates, at a distance such, that a torque in clockwise direction according to the representation of FIG. 1 is produced onto the lid 4. Thus, the produced torque urges the lid 4 in the direction towards the open position. In the dead centre position of the lid 4, the force line of action 39 of the adjustment arm 26 intersects the axis of rotation 11, so that no torque is produced by the adjustment arm 26 onto the lid 4. Across the pivot angle range, starting from the dead centre position to the closed position, the force line of action 39 of the adjustment arm 26 intersects the axis of rotation 11 at a distance such, that a torque in a counter-clockwise direction, according to the representation of FIG. 3, is produced onto the lid 4. Thus, the produced torque acts on the lid 4 in direction towards the closed position. Thus, in a pivot angle range shortly before reaching the closed position, a pulling torque acts on the lid 4, so that the lid 4 is securely held in the closed position.

To adjust the torque that is produced by the spring accumulator 12 onto the lever 19, the adjustment lever 25 is pivotably fastened around an adjustment axis 33 on the lever 19. Thus, the distance between the connection point of the spring accumulator 12 to the adjustment lever 25 and the pivot axis 19 can be adjusted. The effective lever arm, with which a torque is produced by the spring accumulator 12 onto the lever 19, can be changed.

An adjustment screw 31 serves to adjust the position of the adjustment lever 25. The adjustment screw 31 is screwed into a threaded bore 32 of the lever 19. The adjustment screw 31 serves as an abutment for the adjustment lever 25. The force line of action (adjustment axis 16) of the spring accumulator 12 is aligned such that the adjustment lever 25 is acted upon with a torque in a counter-clockwise direction according to the representation of FIG. 1. The adjustment screw 31 supports the adjustment lever 25 against a rotation in a counter-clockwise direction. By means of adjusting the screwing-in depth of the adjustment screw 31 within the threaded bore 32, the position of the abutment, which is represented, in this case, by means of the free end of the adjustment screw 31, can be changed. Thus, the pivot position of the adjustment lever 25 can be changed. Generally, the adjustment lever 25 can also obviously be acted upon by a torque in the other direction. The adjustment screw 31 can support correspondingly the adjustment lever 25 in the other direction. Different retaining mechanisms are conceivable that lock the adjustment lever 25 completely on the lever 19.

The lever 19 has a slot 40 that extends starting from an outer contour 41 of the lever 19 radially towards the pivot axis 20 and ends in the central bore 21. The slot 40 is arranged on the side of the lever 19 facing away from the spring accumulator 12 and the adjustment arm 26. Thus, during the application of a force by the spring accumulator 12 and the adjustment arm 26 onto the lever 19, the lever 19 is slightly deformed such that the central bore 21 constricts. Thus, the lever 19 or the wall of the central bore 21, respectively, is clamped onto the pin 22. The frictional force between the wall of the central bore 21 and the pin 22 is, thus, increased. This ensures that the lid 4 is also held across a specific pivot angle range in any arbitrary position, when the torques, that are produced by the adjustment arm 26 because of the weight of the lid 4 and of the spring accumulator 12 onto the lever 19, do not exactly cancel each other out.

A damper 34 is provided on the first support arm 5. The damper 34 has a housing 35 that is connected to the first support arm 5. A slider 36 is axially displaceably held in the housing 35. The slider 36 is acted upon by a force towards an extended position shown in FIG. 1. A spring provides the force and is arranged in the housing 35. The spring is supported on the housing 35 and on the slider 36. An abutment element 37, with an abutment face 38, is fastened onto the body-sided first fitting part 2. In the open position (FIG. 1) of the lid 4, the slider 36 does not abut the abutment face 38. When the lid 4 is moved into the closed position (FIG. 3), the slider 36 approaches the abutment face 38, until it abuts it. The slider 36 only abuts the abutment face 38 when the lid 4 is arranged between the dead center position and the closed position when a pulling torque acts on the lid 4. After the slider 36 comes into abutment with the abutment face 38, the slider 36 is further retracted. As further pivoting of the lid 4 occurs, until reaching the closed position, the slider 36 moves against the spring force into the housing 35, so that the pulling of the lid 4 towards the body 2 is dampened. The damper 34 can have further damping means, such as, for example, the damper may be formed as a hydraulic damper.

The damper 34 can be formed so that the slider 36 is held in the housing 35 like a refill of a ballpoint pen in a resting position between the fully retracted position and the fully extended position. In the resting position, the slider 36 is in a nearly completely retracted position. By retracting the slider 36 into the completely retracted position, the slider 36 is released and can be displaced by the spring mechanism, arranged in the housing, to the completely extended position. When displacing the slider 36 again to the completely retracted position, the slider 36 is locked and can, because of this, only be extended up to the resting position. Thus, an automatic opening of the lid can be produced by pushing the lid 4 in its closed position towards the body 2. When the slider 36 is released, and after releasing the lid 4, the lid 4 is displaced up to or beyond the dead centre position. Thus, the spring accumulator 12 can be adjusted such that the lid 4, after exceeding the dead center position, is displaced by the spring accumulator 12 and is self-actuatedly up to the open position.

The present disclosure has been described with reference to the preferred embodiments. Obviously, modifications and alternations will occur to those of ordinary skill in the art upon reading and understanding the preceding detailed description. It is intended that the present disclosure be construed to include all such alternations and modifications insofar as they come within the scope of the appended claims or their equivalents.

The invention claimed is:

1. A holding element for adjusting a lid of a piece of furniture between a closed position and an open position, comprising:

a first fitting part connectable to a body of a piece of furniture;

a second fitting part connectable to the lid;

a first support arm, the first support arm is pivotably fastened around a first body axis to the first fitting part and pivotably fastened around a first lid axis to the second fitting part;

a second support arm, the second support arm is pivotably fastened around a second body axis to the first fitting part and pivotably fastened around a second lid axis to the second fitting part;

a lever is pivotably fastened around a pivot axis to the first fitting part;

an adjustment arm, the adjustment arm is pivotably connected to the lever at a distance from the pivot axis and is pivotably fastened around a third lid axis to the second fitting part;

a force drive urges the lever with a force in a first pivot direction;

wherein in the open position of the lid, the first support arm and the second support arm intersect each other.

2. The holding element according to claim 1, wherein the body axes, the lid axes and the pivot axis are arranged parallel to each other.

3. The holding element according to claim 1, wherein the force drive is formed as a spring accumulator, said spring accumulator is supported on the first fitting part and on the lever.

4. The holding element according to claim 3, wherein the spring accumulator further comprises a compression spring element.

5. The holding element according to claim 3, wherein an adjustment mechanism is provided for adjusting the force application point, on which the spring accumulator acts on the lever.

6. The holding element according to claim 5, wherein the adjustment mechanism further comprises an adjustment lever, the adjustment lever is pivotably fastened to the lever and is retainable in different pivot positions relative to the lever and the spring accumulator is pivotably fastened to the adjustment lever.

7. The holding element according to claim 1, wherein the lever has a first lever portion and a second lever portion, the first lever portion starts from the pivot axis, the second lever portion extends from the pivot axis opposite to the first lever portion and wherein the adjustment arm is pivotably fastened to the first lever portion and the force drive engages the second lever portion.

8. The holding element according to claim 7, wherein the lever has a central bore, the central bore rotatably supports the lever on a trunnion, the trunnion is connected to the first fitting part.

9. The holding element according to claim 8, wherein the lever has a slot, the slot ends, starting from an outer contour of the lever, in the central bore.

10. The holding element according to claim 9, wherein the slot is arranged such that when a force is applied by the adjustment arm and by the spring accumulator onto the lever, the lever with a wall, which delimits the central bore, is clamped onto the trunnion.

11. The holding element according to claim 1, further comprising a damper, the damper dampens the pivot movement of the lid until the lid reaches the closed position.

12. The holding element according to claim 11, wherein the damper includes a housing that is connected to the first support arm, a slider is axially displaceable relative to the housing, the slider is urged towards an extended position by a force, an abutment element is fastened on the first fitting part, and when the lid is moved into the closed position, the slider approaches the abutment element until it abuts the abutment element moving the slider into a retracted position.

13. The holding element according to claim 12, wherein the damper is formed such that the slider is held in the housing in a resting position between a completely retracted position and a completely extended position, the slider is released by retracting into the completely retracted position and is displaced by a spring mechanism arranged in the housing, into the completely extended position, and that, when the slider is displaced again into the completely retracted position, the slider is locked and is extended up to the resting position.

* * * * *

UNITED STATES PATENT AND TRADEMARK OFFICE

CERTIFICATE OF CORRECTION

PATENT NO. : 8,321,996 B2
APPLICATION NO. : 12/863671
DATED : December 4, 2012
INVENTOR(S) : Artur Hirtsiefer It is certified that error appears in the above-identified patent and that said Letters Patent is hereby corrected as shown below:

Column 1

Line 11, "Disclosures" should be --disclosures--

Signed and Sealed this
Fifth Day of March, 2013

Teresa Stanek Rea
*Acting Director of the United States Patent and Trademark Office*